United States Patent [19]

Visser

[11] Patent Number: 4,773,295

[45] Date of Patent: Sep. 27, 1988

[54] STRINGED INSTRUMENT

[76] Inventor: Norbert Visser, Valkenlaan 72, NL-1871 AV Schoorl, Netherlands

[21] Appl. No.: 127,059

[22] Filed: Dec. 1, 1987

[30] Foreign Application Priority Data

Dec. 8, 1986 [NL] Netherlands ..... 8603120

[51] Int. Cl.[4] ..... G10D 1/02

[52] U.S. Cl. ..... 84/276; 84/277

[58] Field of Search ..... 84/274–277

[56] References Cited

U.S. PATENT DOCUMENTS

| | | | |
|---|---|---|---|
| 66,347 | 7/1867 | Hulskamp | 84/274 |
| 496,397 | 5/1893 | Clopton | 84/275 X |
| 3,383,970 | 5/1968 | Di Sibio | 84/276 |

FOREIGN PATENT DOCUMENTS

| | | | |
|---|---|---|---|
| 138240 | 4/1985 | European Pat. Off. | 84/275 |
| 849293 | 7/1981 | U.S.S.R. | 84/274 |

*Primary Examiner*—Lawrence R. Franklin

*Attorney, Agent, or Firm*—John P. Snyder

[57] ABSTRACT

A sound transmission system for a musical instrument of the violin family includes a pair of bifurcated, wish bone shaped structures located internally of the body of the instrument. The first structure extends between the top and bottom sound boards adjacent the neck and has one arm connected to the top board and the other connected to the bottom board; both diverge from each other and are concave shaped. The second structure extends from the top board to the bottom arm of the first structure, adjacent but spaced from the bridge away from the neck. Both of the second structure's arms are free floating and have their free ends connected to opposite ones of the first structure's arms.

10 Claims, 2 Drawing Sheets

STRINGED INSTRUMENT

The invention relates to a stringed instrument, such as a violin, viola, violoncello or contrabass, comprising: a peripheral wall serving as a frame; a top board attached to the one side thereof; a bottom board attached to the other side thereof; which peripheral wall bounds with the said boards a sound space and bears a neck provided with tensioning members for strings extending outside this sound space; attaching members for the strings arranged on the peripheral wall and/or the top board on the side away from the neck; a number of strings extending approximately parallel to one another over the top board between the tensioning members and the attaching members; a bridge extending transversely of the longitudinal direction of the strings above the top board, supporting the strings and forced by the tensioning in these strings in the direction of the sound space, which bridge is connected directly to the top board and connected to the bottom board via transmitting means for transmitting of the string vibrations to these boards; a more or less fork-like element situated in the sound space having a first connecting part extending close to the peripheral wall in the area of the relevant end of the neck between the top board and the bottom board and being attached to the latter, which part bears two beams extending more or less in the direction of the attaching means, the beams being connected over their whole length with the top board and the bottom board; and a second more or less fork-like element situated in the sound space.

By way of introduction to the invention the tone forming of a normal violin will now first be described.

The tone forming begins with the setting in vibration by means of a bow of a string which transmits the vibrations to the bridge. This bridge is positioned with two feet, a left foot and a right foot, on the top board of the violin, and there it frees, as it were, the tone. This is not however sufficient to also include the total sound body in this tone forming, that is, those parts of the violin which could provide a significant contribution to sound production. There has in fact to be some manner of transmitting the vibrations from the string, via the bridge and the top board to the bottom board. The peripheral wall is not sufficiently capable of doing this. The air vibrations produced in the sound space are likewise inadequate for this purpose. The normal violin therefore comprises a connection between the top board and the bottom board. This connection, the so-called "sound-post" usually takes the form of a more or less circular cylindrical wooden part which extends from the area of, but at some distance from, the bridge in sloping direction between the top board and the bottom board. Without this sound-post the tone forming would certainly attempt to develop from the top board but the resonance would remain weaker than required.

All the stringed instruments referred to here are always based on a dual principle. The tone forming begins in the first place at the string, and spreads via the bridge and the top board over the second sound body. In the second place the tone that has become "peripheral" must then re-concentrate itself in the bridge. A question and answer game comes into being. It is this interaction between this spreading to the periphery, the first principle, and the concentration backward to the centre, the second principle, which makes possible the strongly concentrated string tone as we known it from good stringed instruments.

This principle implies a noteworthy problem which expresses itself in the placing of the sound-post as already briefly referred to. If this sound-post is placed directly beneath the bridge, there will certainly be a spreading to the top board, but since the bottom board is directly linked to the bridge vibrations, there is no question of a distinct interaction. The vibrations pass, as it were, straight through the sound-post. This is the reason why the sound-post is not placed beneath the bridge, but directly behind it. The distance between sound-post and bridge depends on the type of violin and is chosen in accordance with the curvature of the boards, the thickness of the wood and so on.

A stringed instrument of the above described type is known from EP-A-No. 0138240, in which the applicant in respect of the current application is named as inventor.

The invention has for its object to now give a stringed instrument a form such that it shows an improvement compared to the above mentioned state of the art.

To this end the stringed instrument according to the invention displays the feature that the second more or less fork-like element comprises a second connecting part that is concave curved in the direction of the neck and extends between the top board and the beam attached to the bottom board, to which beam it is attached, which part is located as seen in top view at a small distance from the bridge between this bridge and the attaching means, and which bears two legs extending more or less in the direction of the attaching means, which legs extend from the central area of the concave curved portion to the end of the upper beam and the lower beam respectively, are connected to these ends and otherwise extend freely in the sound space.

The first connecting part preferably extends freely into the sound space.

The first connecting part can preferably also have a constricted form.

It may be required that the second connecting part display a slightly inclining position, such that its attachment to the top board lies closer to the projection of the bridge on the top board than its attachment to the bottom board at the projection of the bridge on the bottom board. Such an inclining position of the second connecting part produces a slightly altered tone forming of the stringed instrument.

The stringed instrument can furthermore be characterized by two blocks extending into the sound space between the top board and the bottom board and each adhered with the whole of the relevant surface to the peripheral wall, the free surface of which blocks has a round, mildly concave arched form, the first block bordering on the neck and the second block being situated in the area of the attaching members.

It may be of importance for the legs to display a somewhat thickened central portion.

The stringed instrument according to the invention preferably displays the feature that the second more or less fork-like element is of wood and that the direction of the grain of the concave curved part is positioned more or less perpendicular to the boards and the grain direction of the legs is more or less parallel to the boards.

In an embodiment that is simple to manufacture the concave curved part is divided over at least approximately its central transverse plane and the surfaces facing each other are connected to each other.

The instrument according to the invention can with advantage display the special feature that the one leg extends substantially only into that portion of the sound space bounded be the top board and a central longitudinal plane which extends roughly parallel to the principal plane of the boards and that the other leg substantially extends only into that portion of the sound space bounded by the bottom board and said central longitudinal plane.

The invention will now be elucidated with reference to the drawings, in which:

FIG. 5 shows a detail of a connecting part of the second fork-like element, the part being in slightly sloping position.

Figure 1:
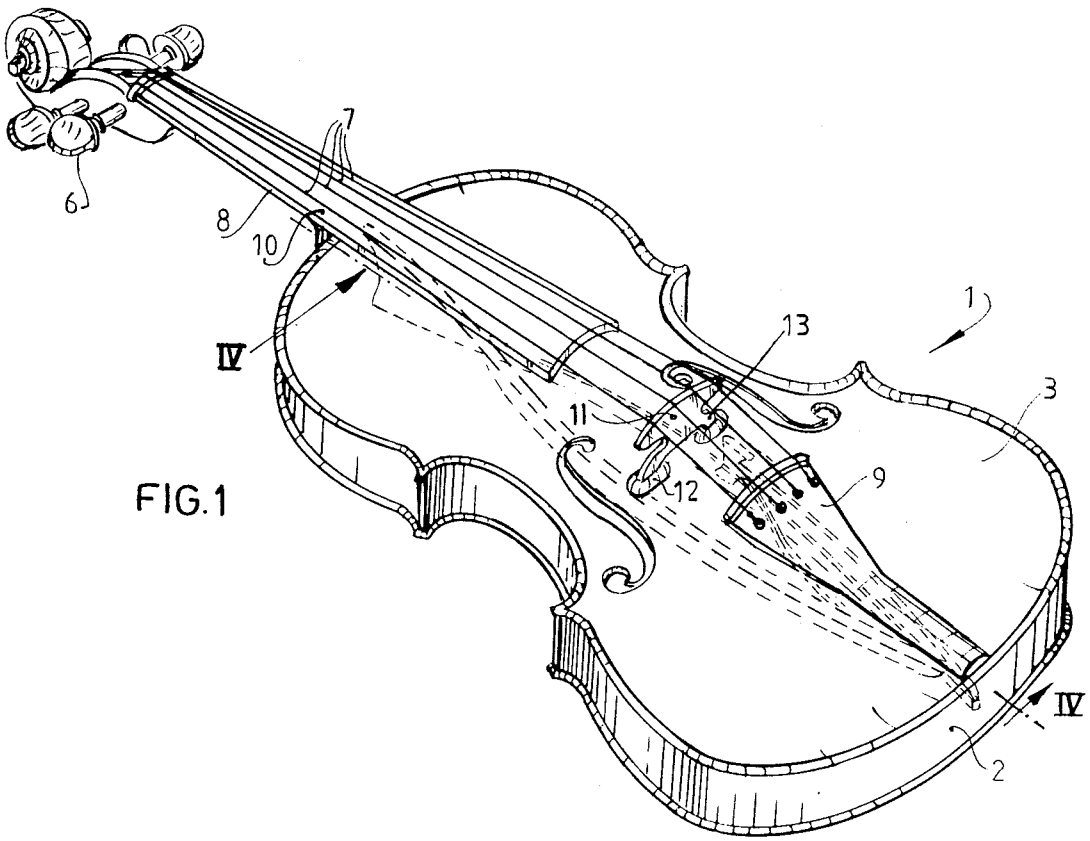
FIG. 1 shows a violin 1 in perspective view.

FIG. 1 shows a violin 1 according to the invention. This comprises a peripheral wall 2 serving as frame. Attached to the one side thereof is a top board 3 and to the other side a bottom board 4. The peripheral wall 2 bounds together with boards 3 and 4 a sound space 5 (see also the other figures), and bears a neck 8 extending outside this sound space and provided with tensioning members 6 for strings 7. Arranged on peripheral wall 2 and/or top board 3 on the side away from the neck 8 are attaching members 9 for strings 7. The strings 7 extend approximately parallel to one another between tensioning members 6 and attaching members 9, and over the top board 3. Above the neck 8 and partially above top board 3 extends the fingerboard 10 on which a player can press a string with a finger in order to obtain a determined string length and thereby a particular pitch. The violin further comprises a bridge 11 extending transversely of the longitudinal direction of the strings 7 above the top board 3, supporting strings 7 and forced by the tensioning in these strings 7 in the direction of the sound space 5, which bridge is connected directly to the top board 3 via a left foot 12 and a right foot 13 and connected to the bottom board 4 via transmitting means to be described later, this such that when the bow is applied to the strings vibrations generated in these strings 7 can be transmitted to boards 3 and 4.

The internal construction of a stringed instrument according to the invention to be described hereinafter can be clearly seen in the FIGS. 2, 3, 4 and 5, to which reference is now mainly made. This internal structure is indicated in FIG. 1 with broken lines.

Figure 2:
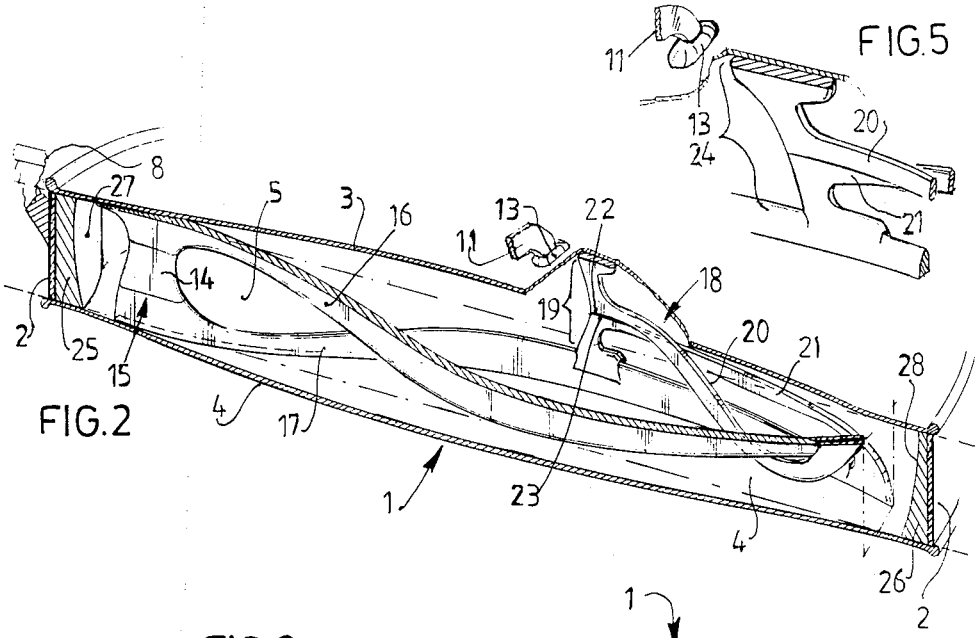
FIG. 2 shows a partly broken away, perspective view of a detail of the violin as in FIG. 1, in which is shown the internal structure in accordance with the invention.
Figure 3:
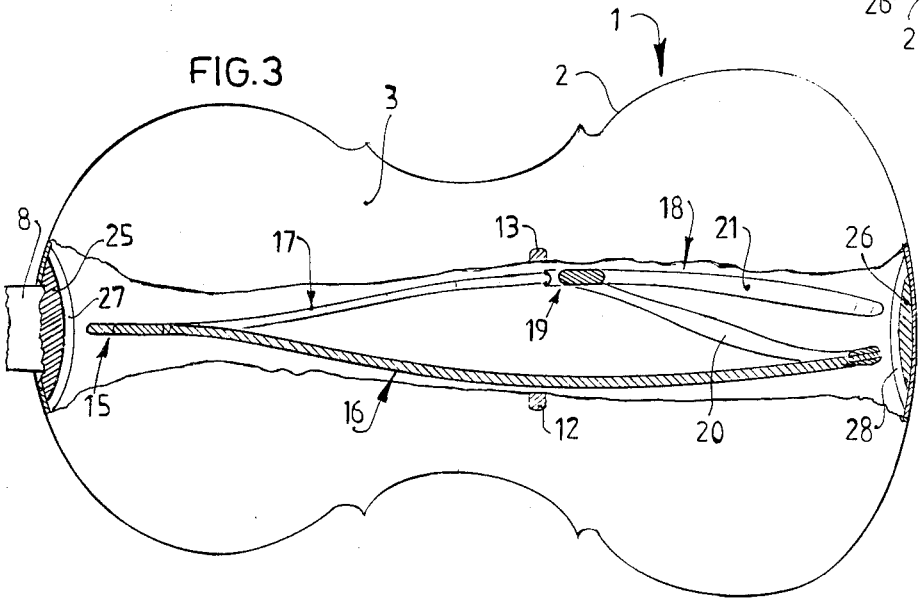
FIG. 3 is a top view of the violin as in FIG. 1 with the top board partially broken away.
Figure 4:
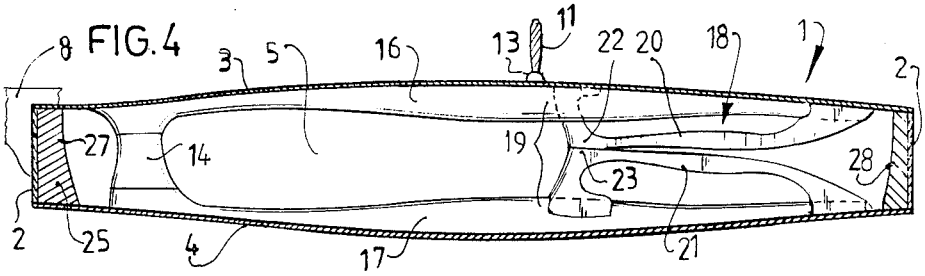
FIG. 4 is the side view IV—IV of the violin as according to FIG. 1, with the peripheral wall omitted.

The stringed instrument 1 comprises two blocks 25, 26 extending into the sound space 5 between the top board 3 and the bottom board 4 and each adhered with the whole of the relevant surface to the peripheral wall 2, the free surfaces 27, 28 of which blocks which border on sound space 5 each have a round, mildly concave, arched form, the first block 25 bordering on the neck via peripheral wall 2 and the second block 26 being situated in the area of the attaching members 9. It is noted that the attaching members 9 shown in FIG. 1 are not shown in the FIGS. 2, 3, 4 and 5 for the sake of clarity. As FIGS. 2, 3 and 4 show, blocks 25, 26 further possesss a form such that they are broader on the part bordering on bottom board 4 than on the part bordering on top board 3.

Located in the sound space 5 is a first more or less fork-like element having a constricted connecting part 14 and a part 15 extending close to the peripheral wall 2 in the area of the relevant end of the neck 8 between top board 3 and bottom board 4 and being fixed with adhesive to the latter, which part bears two beams 16 and 17 extending more or less in the direction of attaching means 9, namely the upper bass beam and the lower bass beam, the beams being glued over their whole length to top board 3 and bottom board 4 respectively.

Also located in sound space 5 is a second more or less fork-like element 18 having a part 19 in divided form, which is concave curved in the direction of the neck 8, extends between the top board 3 and the lower bass beam 17 attached to bottom board 4 and is attached to beam 17, which part is situated as seen in top view at a small distance from bridge 11 between this bridge and attaching means 9, and which bears two legs, 20 and 21, an upper leg and a lower leg respectively, extending more or less in the direction of attaching means 9, these legs extending respectively from the central area of the concave curved part 19 to the end of the upper bass beam 16 and the lower bass beam 17, being joined to these ends with adhesive and otherwise extending freely into sound space 5.

Upper leg 20 and lower leg 21 have a slightly thickened central portion.

The second fork-like element, just as all other parts of the sound space, is manufactured from wood. The grain direction of the fork-like element 18 forms an angle with the surface of the boards 3 and 4 such that the grain direction of the concave curved part 19 lies more or less perpendicular to the boards 3, 4 while the direction of the grain of legs 20, 21 is more or less parallel to the boards. In a variant (not drawn) the legs 20, 21 are formed separately of the concave curved part 19 and ahered to it. In such an embodiment the intended grain direction can be realized more precisely.

As is clearly shown in FIGS. 2 and 4, the concave curved part 19 is formed divided at least roughly over its central transverse plane and the surfaces 22, 23 facing toward each other are joined to each other with adhesive.

FIG. 4 clearly shows that the upper leg 20 substantially extends only in the upper portion of sound space 5 that is bounded by top board 3 and a central longitudinal plane of violin 1, which plane extends approximately parallel to the principal plane of boards 3, 4, and lies at a roughly equal distance from both boards. The lower leg 21 substantially extends only in the lower portion of the sound space bounded by bottom board 4 and the central longitudinal plane referred to above. Attention is drawn to the fact that in the embodiment shown this central longitudinal plane deviates a little from the plane in which the contact surfaces 22, 23 are located. This is so because the slightly concave curved part 19 does not extend between top board 3 and bottom board 4, but between top board 3 and the upper surface of the lower bass beam 17 that is slightly elevated relative to bottom board 4.

FIG. 5 shows a detail of a variant. Shown in the FIGS. 2 and 4 is the concave curved connecting part. The feed thereof lie roughly directly above each other. The corresponding concave curved connecting part 24 as in FIG. 5 has a slightly sloping position, such that its attachment to top board 3 lies closer to the projection of the bridge 11 on the top board 3 than its attachment to the bottom board 4 at the projection of the bridge 11 on bottom board 4. It is hereby noted that the attachment to the bottom board takes place via the lower bass beam 17.

What is claimed is:

1. A stringed instrument, from the group consisting of a violin, viola, cello or contrabass, comprising:

a peripheral wall serving as a frame, a top board attached to one side thereof, a bottom board attached to the other side thereof, which peripheral wall bounds with said top and bottom boards a sound space and bears a neck provided with tensioning members for strings extending outside said sound space, attaching means for the strings arranged on said peripheral wall and/or said top board on the side away from the neck, a number of strings extending approximately parallel to one another over said top board between said tensioning members and said attaching means, a bridge extending transversely of the longitudinal direction of the strings above said top board, supporting the strings and forced by the tension in these strings in the direction of the sound space, which bridge is connected directly to said top board and connected to said bottom board via transmitting means for transmitting the string vibrations to said top and bottom boards; said transmitting means comprising:

a first fork-like element situated in said sound space having a first connecting part extending close to said peripheral wall in the area of the relevant end of said neck between said top board and said bottom board and being attached to the latter, which first connecting part comprises first and second beams extending in the direction of said attaching means, said first and second beams being connected over their whole length to said top board and said bottom board, respectively; and a second fork-like element situated in said sound space, characterized in that said second fork-like element comprises a second connecting part that is concave curved in the direction of said neck and extends between said top board and said second beam, to which beam it is attached, said second connecting part being located at a small interval from said bridge between said bridge and said attaching means, and said second connecting part including first and second legs extending in the direction of said attaching means, which first and second legs extend respectively from the central area of the concave curved portion to the end of said first beam and the end of said second beam, are connected to these ends and otherwise extend freely in said sound space.

2. Stringed instrument as claimed in claim 1, characterized in that the first connecting part extends freely in the sound space.

3. Stringed instrument as claimed in claim 2, characterized in that the first connecting part has a constricted form.

4. Stringed instrument as claimed in claim 3, characterized in that the second connecting part displays a slightly inclining position, such that its attachment to the top board lies closer to the projection of the bridge on said top board than its attachment to said second beam at the projection of said bridge onto said bottom board.

5. Stringed instrument as claimed in claim 1, characterized by two blocks extending into the sound space between the top board and the bottom board and each adhered with the whole of the relevant surface to the peripheral wall, the free surface of which blocks has a mildly concave arched form, the first block bordering on the neck and the second block being situated in the area of the attaching means.

6. Stringed instrument as claimed in claim 5, characterized in that the legs display a somewhat thickened central portion.

7. Stringed instrument as claimed in claim 1, characterized in that the second fork-like element is made of wood and that the direction of the grain of the concave curved part lies perpendicular to the boards and the grain direction of the legs is parallel to said boards.

8. Stringed instrument as claimed in claim 1, characterized in that the concave curved second connecting part is divided over at least approximately its central transverse plane and that the surfaces facing each other are connected to each other.

9. Stringed instrument as claimed in claim 1, characterized in that said first leg substantially extends only into that portion of the sound space bounded by the top board and a central longitudinal plane which extends substantially parallel to the principal plane of the boards and that said second leg substantially extends only into that portion of said sound space bounded by the bottom board and said central longitudinal plane.

10. In a stringed instrument, a body comprising:

the combination of top and bottom boards joined peripherally by a peripheral wall and defining a sound space, a neck joined to and extending from one end of the body, a bridge joined to top board generally centrally of the body, string attaching means at that end of the body opposite the neck.

and strings extending between the free end of the neck and the string attaching means and bearing under tension upon the bridge, the improvement which comprises sound transferring means for transferring sound vibrations from the bridge and top board to the bottom board, the sound transferring means comprising:

a first bifurcated member having a bight portion extending between and secured to the top and bottom boards adjacent but spaced from the juncture of the neck and the body, said first bifurcated member further having upper and lower legs of generally wishbone form extending from the bight portion toward the opposite end of the body, the upper and lower legs having respective upper and lower edges secured to the top board and the bottom board, respectively, and a second bifurcated member having a bight portion and upper and lower legs, the bight portion of the second bifurcated member being joined to the top board adjacent but spaced from the juncture of the bridge and the top board and being joined to an intermediate portion of the lower leg of the first bifurcated member, the free ends of the legs of the second bifurcated member being joined to the free ends of the legs of the first bifurcated member while the intermediate portions of the legs of the second bifurcated member remain free to vibrate.

* * * * *